US010660421B2

(12) United States Patent
Crawford et al.

(10) Patent No.: US 10,660,421 B2
(45) Date of Patent: May 26, 2020

(54) CONSUMABLE PRODUCT PACKAGING

(71) Applicant: Colgate-Palmolive Company, New York, NY (US)

(72) Inventors: John Crawford, Mahopac, NY (US); Kiat-Cheong Toh, Forest Hills, NY (US); Juhi Solanki, Jersey City, NJ (US); Francis Tatu, Manlius, NY (US)

(73) Assignee: Colgate-Palmolive Company, New York, NY (US)

( * ) Notice: Subject to any disclaimer, the term of this patent is extended or adjusted under 35 U.S.C. 154(b) by 76 days.

(21) Appl. No.: 15/759,999

(22) PCT Filed: Sep. 16, 2015

(86) PCT No.: PCT/US2015/050335
§ 371 (c)(1),
(2) Date: Mar. 14, 2018

(87) PCT Pub. No.: WO2017/048244
PCT Pub. Date: Mar. 23, 2017

(65) Prior Publication Data

US 2018/0249808 A1 Sep. 6, 2018

(51) Int. Cl.
*A45D 40/04* (2006.01)
*A45D 40/00* (2006.01)

(52) U.S. Cl.
CPC ..... *A45D 40/04* (2013.01); *A45D 40/00* (2013.01); *A45D 2040/005* (2013.01); *A45D 2040/0043* (2013.01)

(58) Field of Classification Search
CPC ..... A45D 40/04; A45D 40/00; A45D 2040/0043; A45D 2040/005; A45D 40/06; A45D 40/16; A45D 40/02; A45D 2040/0031; A45D 2040/208; B05C 17/01; B05C 17/0116; B65D 83/0005; B65D 83/0011; B65D 83/0033
See application file for complete search history.

(56) References Cited

U.S. PATENT DOCUMENTS 3,132,743 A 5/1964 Wolff
3,146,881 A * 9/1964 Metreaud ..... A45D 40/16 401/75

(Continued)

FOREIGN PATENT DOCUMENTS

WO 2002/003830 1/2002

OTHER PUBLICATIONS

International Search Report and Written Opinion of the International Searching Authority in International Application No. PCT/US2015/050335, dated Aug. 23, 2016.

*Primary Examiner* — David J Walczak

(57) ABSTRACT

A consumer product includes a housing defining an internal volume. An engaging mechanism is coupled to or integral with the housing. A cartridge is configured to be inserted into the internal volume through a first end of the housing, and the engaging mechanism is configured to engage a second engaging mechanism on the cartridge. An elevation mechanism is positioned at least partially within the internal volume. An actuating device is coupled to the housing proximate to a second end of the housing. The elevation mechanism is configured to move in response to actuation of the actuating device.

6 Claims, 12 Drawing Sheets

(56) References Cited

U.S. PATENT DOCUMENTS

| | | | | | |
|---|---|---|---|---|---|
| 3,429,643 | A | * | 2/1969 | Seaver | A45D 40/04 401/75 |
| 3,771,881 | A | * | 11/1973 | Swenson | A45D 40/04 401/75 |
| 5,255,990 | A | * | 10/1993 | Dornbusch | A45D 40/04 401/172 |
| 5,437,513 | A | * | 8/1995 | Favre | A45D 40/04 401/175 |
| 5,496,122 | A | | 3/1996 | Fattori | |
| 5,505,041 | A | | 4/1996 | Harlan | |
| 6,095,708 | A | | 8/2000 | Butaud | |
| 6,371,673 | B1 | | 4/2002 | Gueret | |
| 6,648,503 | B2 | | 11/2003 | Tanaka et al. | |
| 9,210,985 | B2 | * | 12/2015 | Arwatz | A45D 34/04 |

* cited by examiner

CONSUMABLE PRODUCT PACKAGING

BACKGROUND

Consumer products, such as, for example, under-arm protection ("UAP") devices include a plastic housing having a consumable product positioned therein. When the consumer product is a UAP device, the consumable product typically includes deodorant or antiperspirant. Deodorant is a substance that is applied under the arms of a user to prevent body odor that is caused by the bacterial breakdown of perspiration (i.e., sweat). Antiperspirant is a subgroup of deodorant that aims at preventing perspiration and the body odor associated therewith.

Each time a user uses the consumer product, a portion of the consumable product (e.g., a deodorant stick) is used up, which gradually causes the level (e.g., height) of the consumable product to decrease below the upper edge of the housing. The user may turn a thumb screw coupled to the housing to raise the consumable product back above the upper edge of the housing so that the user may once again access the consumable product. Once the consumable product is used up or exhausted, the consumer product is typically thrown away, and a new consumer product is purchased and used.

BRIEF SUMMARY

A consumer product includes a housing defining an internal volume. An engaging mechanism is coupled to or integral with the housing. A cartridge is configured to be inserted into the internal volume through a first end of the housing, and the engaging mechanism is configured to engage a second engaging mechanism on the cartridge. An elevation mechanism is positioned at least partially within the internal volume. An actuating device is coupled to the housing proximate to a second end of the housing. The elevation mechanism is configured to move in response to actuation of the actuating device.

A consumer product includes a cartridge. The cartridge includes a sleeve and an engaging mechanism coupled to or integral with the sleeve. A riser is positioned at least partially within the sleeve, and the sleeve and the riser at least partially define an internal volume of the cartridge. A consumable product is positioned within the internal volume of the cartridge. A portion of a clutch is coupled to the riser. The consumable product is advanced within the sleeve by the riser in response to rotation of the portion of the clutch.

A consumer product includes a housing defining an internal volume. A first engaging mechanism is coupled to or integral with the housing. The first engaging mechanism is selected from the group consisting of an opening formed through the housing, a recess formed in an inner surface of the housing, and a protrusion formed on an inner surface of the housing and extending inwardly therefrom. A cartridge is removably positioned within the internal volume of the housing, and the cartridge is configured to be inserted into the internal volume through a first end of the housing. A second engaging mechanism is coupled to or integral with the cartridge, and the first engaging mechanism is configured to engage the second engaging mechanism when the cartridge is inserted into the internal volume. A consumable product is positioned within the cartridge. An elevation mechanism is positioned at least partially within the internal volume. An actuating device is coupled to the housing proximate to a second end of the housing, and the elevation mechanism is configured to move in response to actuation of the actuating device.

A consumer product includes a housing defining an internal volume. A shaft extends at least partially within the internal volume, and an outer surface of the shaft is threaded. A riser is positioned within the internal volume and around the shaft. An inner surface of a portion of the riser includes threads, and the portion of the riser is biased into a first position where the threads of the riser are not engaged with the threads of the shaft.

A consumer product includes a housing defining an internal volume. A cartridge is configured to be inserted into the internal volume of the housing. A lower end of the cartridge includes a first portion of a clutch and a second portion of the clutch. The first portion of the clutch extends through an opening in a lower end of the housing when the cartridge is positioned within the internal volume. The second portion of the clutch is configured to be coupled to the first portion of the clutch after the first portion of the clutch is inserted through the opening in the lower end of the housing.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
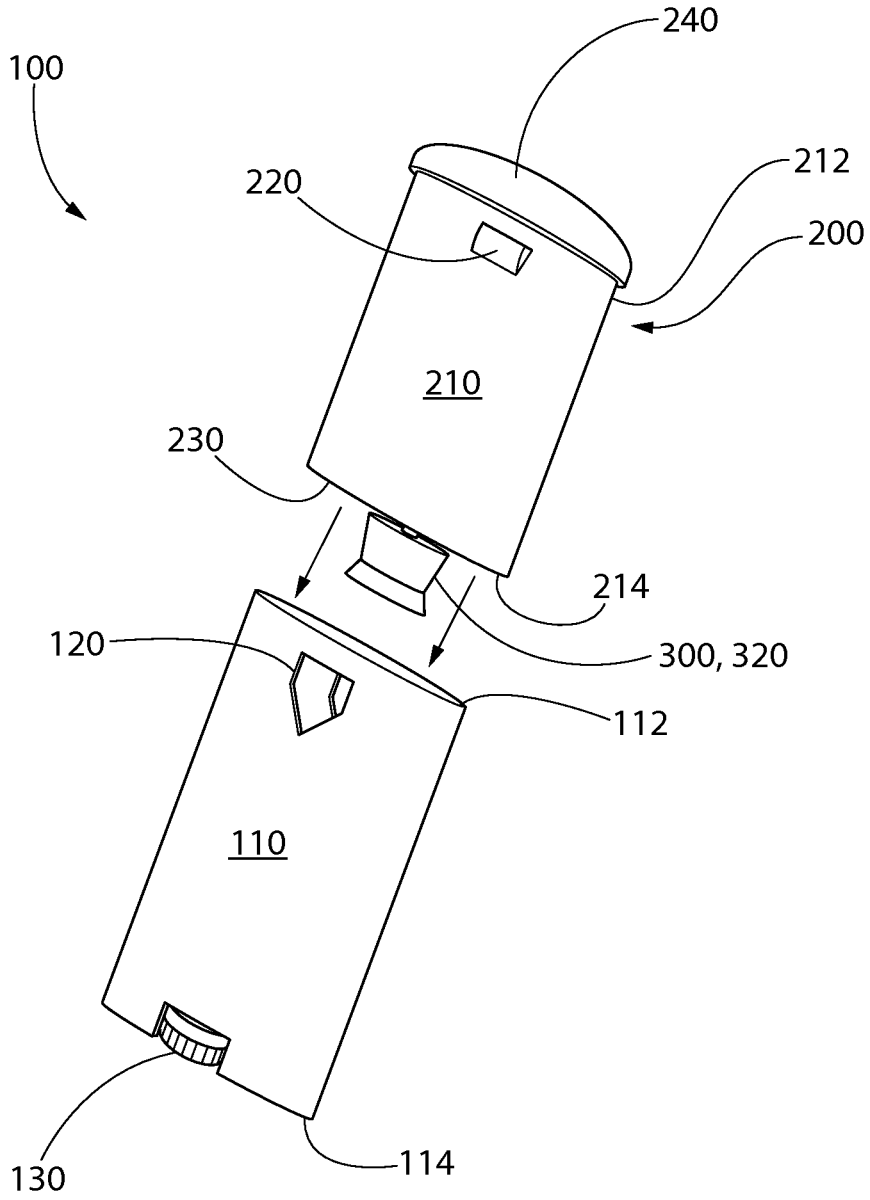
FIG. 1 depicts a perspective view of an illustrative consumer product including a housing and a cartridge, according to an embodiment.

FIG. 1 depicts a perspective view of an illustrative consumer product 100 including a housing 110 and a cartridge 200, according to an embodiment. Although the consumer product 100 shown in the figures and described below is an under-arm protection ("UAP") device for dispensing deodorant or antiperspirant, as will be appreciated, in other embodiments, the consumer product 100 may be used for dispensing face or body salve (e.g., lip balm, moisturizer, sun block, sunburn relief, body lubricant), cosmetics (e.g., lipstick, eye and face makeup, bronzer), adhesive, detergent (e.g., stain remover stick, soap), topical first aid or medication, office or artist supplies (e.g., erasers, paint, pencils, crayons, chalk), lubricant, shoe care (e.g., polish, conditioner, stain remover), condiments, or the like.

The consumer product 100 may include a housing 110 that defines an internal volume. More particularly, the housing 110 may be or include a side wall having a shape that is elliptical (as shown), rectangular, circular, or the like. The housing 110 may include one or more (two are shown) first engaging mechanisms 120. As shown, the first engaging mechanisms 120 may be openings that extend all the way through the housing 110 and provide a path of communication from the internal volume of the housing 110 to the exterior of the housing 110. Although not shown, in another embodiment, the first engaging mechanisms 120 may be or include recesses formed in the inner surface of the housing 110 (i.e., only partially through the housing 110). Although not shown, in yet another embodiment, the first engaging mechanisms 120 may be or include one or more protrusions that are coupled to or integral with the inner surface of the housing 110 and extend inward therefrom.

As shown, the first engaging mechanisms 120 may be positioned closer to an upper end 112 of the housing 110 than a lower end 114 of the housing 110. However, in other embodiments, the first engaging mechanisms 120 may be positioned anywhere along the length of the housing 110 between the upper and lower ends 112, 114. As shown, the first engaging mechanisms 120 may be positioned substantially the same distance from the upper end 110 of the housing 110. In other embodiments, the first engaging mechanisms 120 may be positioned different distances from the upper end 112 of the housing 110. As shown, the first engaging mechanisms 120 are offset from one another by about 180 degrees about a central longitudinal axis through the housing 110, allowing for a potential release by a user's thumb and index finger. In other embodiments, the angle separating the first engaging mechanisms 120 may be anywhere from about 1 degree to about 180 degrees. For example, if four first engaging mechanisms 120 are positioned around the housing 110, the angle between two adjacent first engaging mechanisms 120 may be about 90 degrees. The number of first engaging mechanisms 120 may be more than two (e.g., an even number if the housing 110 is not circular). The first engaging mechanisms 120 may be deployed as pairs that are symmetrical across the major and minor diameter for a balanced distribution of engagement force. As shown, the first engaging mechanisms 120 have a polygonal shape with multiple (e.g., five) sides; however, other shapes and sizes are also contemplated herein. For example, in other embodiments, the first engaging mechanisms 120 may be circular, triangular, rectangular, or the like.

An actuating device 130 may be coupled to the housing 110. As shown, the actuating device 130 is a wheel (e.g., a "thumb screw") that is coupled to the lower end 114 of the housing 110. The actuating device 130 is discussed in more detail below.

The cartridge 200 may be made of rigid plastic, flexibles, laminates, elastomeric plastic, rubber, silicone, wax, paper or other natural fiber (e.g., bamboo, leaf), starch, metal, glass, or the like, or a combination thereof. The cartridge 200 may include a sleeve 210 having a cross-sectional shape that is elliptical (as shown), rectangular, circular, or the like. A first, upper end 212 of the sleeve 210 may be open. A riser 230 may initially be positioned proximate to a second, lower end 214 of the cartridge 200.

The cartridge 200 may include one or more second engaging mechanisms 220. As shown, the second engaging mechanisms 220 may be or include protrusions that are coupled to or integral with the outer surface of the sleeve 210 and extend outward therefrom. Although not shown, in another embodiment, the second engaging mechanisms 220 may be or include openings that are formed at least partially through the sleeve 210. For example, the second engaging mechanisms 220 may be or include recesses formed in the outer surface of the sleeve 210 (i.e., only partially through the sleeve 210).

As shown, the second engaging mechanisms 220 may be positioned closer to the upper end 212 of the cartridge 200 than the lower end 214 of the cartridge 210. However, in other embodiments, the second engaging mechanisms 220 may be positioned anywhere along the length of the cartridge 200 between the upper and lower ends 212, 214. As shown, the second engaging mechanisms 220 may be positioned substantially the same distance from the upper end 212 of the cartridge 200. In other embodiments, the second engaging mechanisms 220 may be positioned different distances from the upper end 212 of the cartridge 200. The second engaging mechanisms 220 may be offset from one another by about 180 degrees about a central longitudinal axis through the cartridge 200. In other embodiments, the angle separating the second engaging mechanisms 220 may be anywhere from about 1 degree to about 180 degrees. For example, if four second engaging mechanisms 220 are positioned around the cartridge 200, the angle between two adjacent second engaging mechanisms 220 may be about 90 degrees. As shown, the second engaging mechanisms 220 have a rectangular shape; however, other shapes and sizes are also contemplated herein. For example, in other embodiments, the second engaging mechanisms 220 may be circular, triangular, polygonal (e.g., with five sides), or the like.

A consumable product 240 may be positioned within an internal volume of the cartridge 200. In the embodiment shown, the consumable product 240 may be or include deodorant or antiperspirant. The deodorant or antiperspirant may be in the form of a gel, a cream, a soft solid, or the like. However, as mentioned above, in other embodiments, the consumable product 240 may be or include face or body salve (e.g., lip balm, moisturizer, sun block, sunburn relief, body lubricant), cosmetics (e.g., lipstick, eye and face makeup, bronzer), adhesive, detergent (e.g., stain remover, soap), topical first aid or medication, office or artist supplies (e.g., erasers, paint, pencils, crayons, chalk), lubricant, shoe care (e.g., polish, conditioner, stain remover), condiments, or the like. Although not shown, in some embodiments, a domed cap or curved lid may be positioned over the upper end 212 of the cartridge 200 to protect the consumable product 240. More particularly, the cap or lid may close off the upper end 212 of the cartridge 200 so that the molten consumable product 240 may be cast into the cartridge 200, forming the leading edge of the consumable product 240 into the desired shape (e.g., curved or arcuate). The cap or lid may also protect the consumable product 240 from damage, contamination, exposure to the atmosphere, etc. The cap or lid may then be removed from the cartridge 200 after the cartridge 200 has been loaded into the housing 110.

A portion 320 of a clutch 300 may be coupled to the cartridge 200. As shown, the portion 320 of the clutch 300 may be coupled to and extending outward from the lower end 214 of the cartridge 200 and/or from the riser 230. The clutch 300 is described in more detail below with respect to FIGS. 8-11. The riser 230 may be configured to move with respect to the sleeve 210 in response to rotation of the portion 320 of the clutch 300. For example, the riser 230 may move upward to raise or advance the consumable product 240 at least partially out of the upper end of the housing 110.

Figure 2:
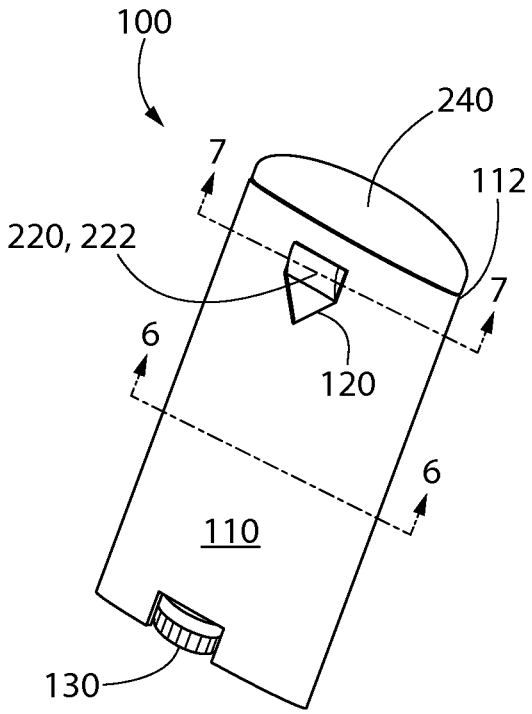
FIG. 2 depicts a perspective view the cartridge loaded into the housing, according to an embodiment.

FIG. 2 depicts a perspective view the cartridge 200 loaded into the housing 110, according to an embodiment. The cartridge 200 (e.g., a new/unused cartridge) may be inserted into the internal volume of the housing 110. More particularly, the lower end 214 of the cartridge 200 may be inserted into the housing 110 through the upper end 112 of the housing 110. The cartridge 200 may be pushed into the internal volume of the housing 110 until the first and second engaging mechanisms 120, 220 engage one another. For example, the cartridge 200 may be pushed into the internal volume of the housing 110 until the second engaging mechanisms (e.g., protrusions) 220 are at least partially received within the first engaging mechanisms (e.g., openings) 120. This may secure the cartridge 200 in place within the housing 110. Once the cartridge 200 is secured within the housing 110 by the first and second engaging mechanisms 120, 220, the user may raise and lower the consumable product 240 within the housing 110 using the actuating device 130, as described in more detail below.

In at least one embodiment, when the second engaging mechanism 220 is a protrusion, as shown, at least one surface (e.g., the lower surface) 222 of the second engaging mechanism 220 may be sloped or curved. For example, the distance between the lower surface 222 and the sleeve 210 may increase moving toward the upper end 212 of the cartridge 200. This may prevent the second engaging mechanism 220 from becoming caught on the upper end 112 of the housing 110 as the second engaging mechanism 220 passes therethrough.

Figure 3:
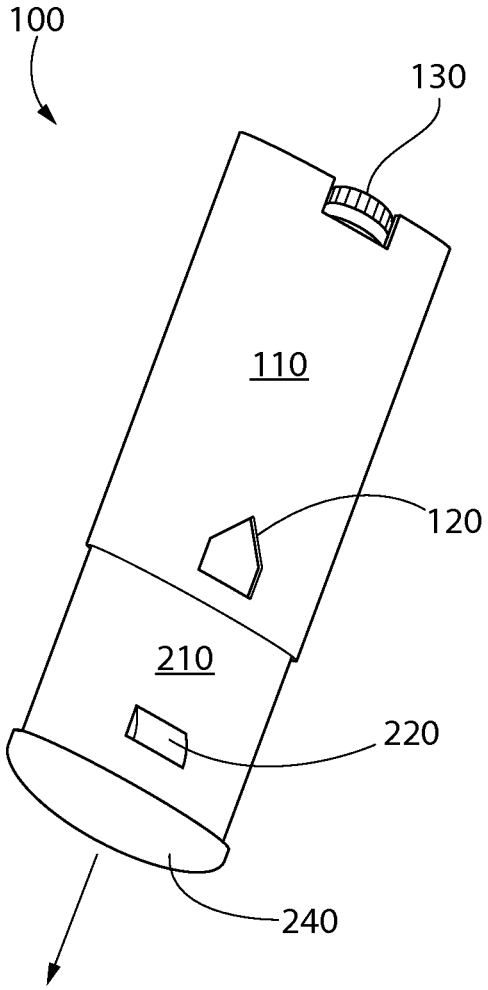
FIG. 3 depicts a perspective view of the cartridge being removed from the housing, according to an embodiment.

FIG. 3 depicts a perspective view of the cartridge 200 being removed from the housing 110, according to an embodiment. Once the consumable product 240 has been used up or exhausted, the user may remove the cartridge 200 from the housing 110 and discard the cartridge 200. As shown, the user may be able to remove the cartridge 200 from the housing 110 by turning the consumer product 100 upside down and squeezing on opposing sides of the housing 110 or by squeezing the second engaging mechanisms 220. As discussed with respect to FIGS. 6 and 7, this may disengage the first and second engaging mechanisms 120, 220.

Figure 4A:
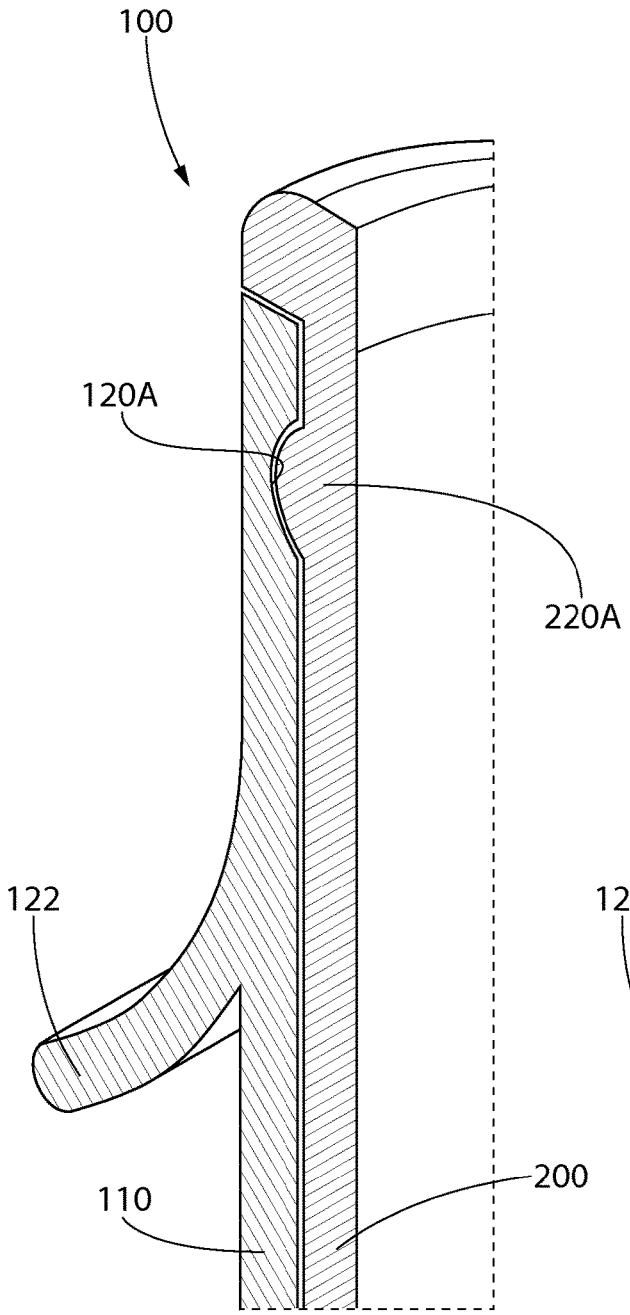
FIGS. 4A and 4B depict cross-sections of partial perspective views of alternative engaging mechanisms on the housing and the cartridge, according to an embodiment.
Figure 4B:
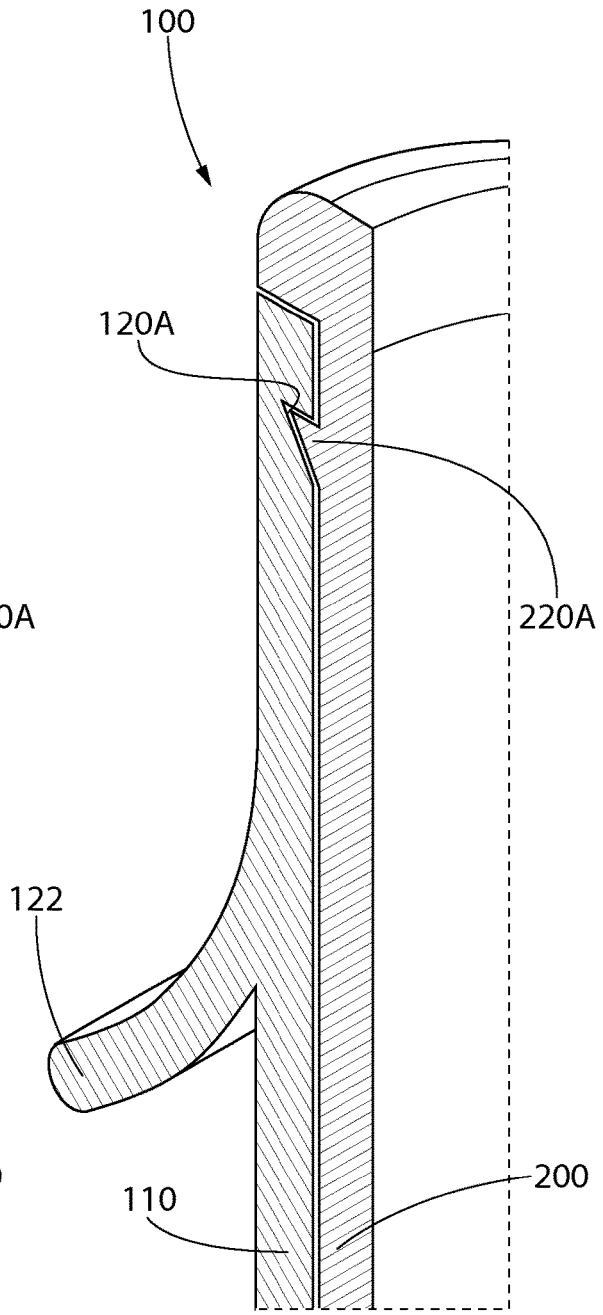

FIGS. 4A and 4B depict cross-sections of partial perspective views of alternative engaging mechanisms 120A, 220A on the housing 110 and the cartridge 200, according to an embodiment. The first engaging mechanism 120A may be a concave recess formed on the inner surface of the housing 110. The second engaging mechanism 220A may be a convex protrusion formed on the outer surface of the cartridge 200. As shown, the second engaging mechanism 220A may fit within the first engaging mechanism 120A when the cartridge 200 is secured within the housing 110.

As shown in FIG. 4A, the first engaging mechanism 120A may have a curved inner surface, and the second engaging mechanism 220A may have a curved outer surface (e.g., like a rounded dimple). In an alternate embodiment, as shown in FIG. 4B, the first engaging mechanism 120A may have one or more substantially planar surfaces. For example, the first engaging mechanism 120A may have a first substantially planar surface that is oriented at an angle from about 30 degrees to about 60 degrees with respect to a central longitudinal axis through the housing 110. The first engaging mechanism 120A may also have a second substantially planar surface that is substantially perpendicular to the central longitudinal axis through the housing 110. Similarly, the second engaging mechanism 220A may have a first substantially planar surface that is oriented at an angle from about 30 degrees to about 60 degrees with respect to a central longitudinal axis through the cartridge 200. The second engaging mechanism 220A may also have a second substantially planar surface that is substantially perpendicular to the central longitudinal axis through the cartridge 200.

When shaped in this manner, second engaging mechanism 220A may function as a barb that secures the cartridge 200 within the housing 110.

In at least one embodiment, the housing 110 may include one or more cantilevers (one is shown: 122) formed on the outer surface thereof. The user may press down on the cantilever 122, which may cause the first and second engaging mechanisms 120A, 220A to disengage one another. The cartridge 200 may then be removed from the housing 110.

In other embodiments, the first and/or second engaging mechanism 120A, 220A may be or include full or partial perimeter snap beads, ferromagnetism, or a friction/interference fit. These may be located anywhere up and down the housing 110 and/or the cartridge 200. Optionally, the physical act of releasing the first and second engaging mechanisms 120A, 220A may be coordinated to also release an auxiliary engagement mechanism, or vice versa, so that the user only needs to perform a single action to release the cartridge 200 from the housing 110.

Figure 5:
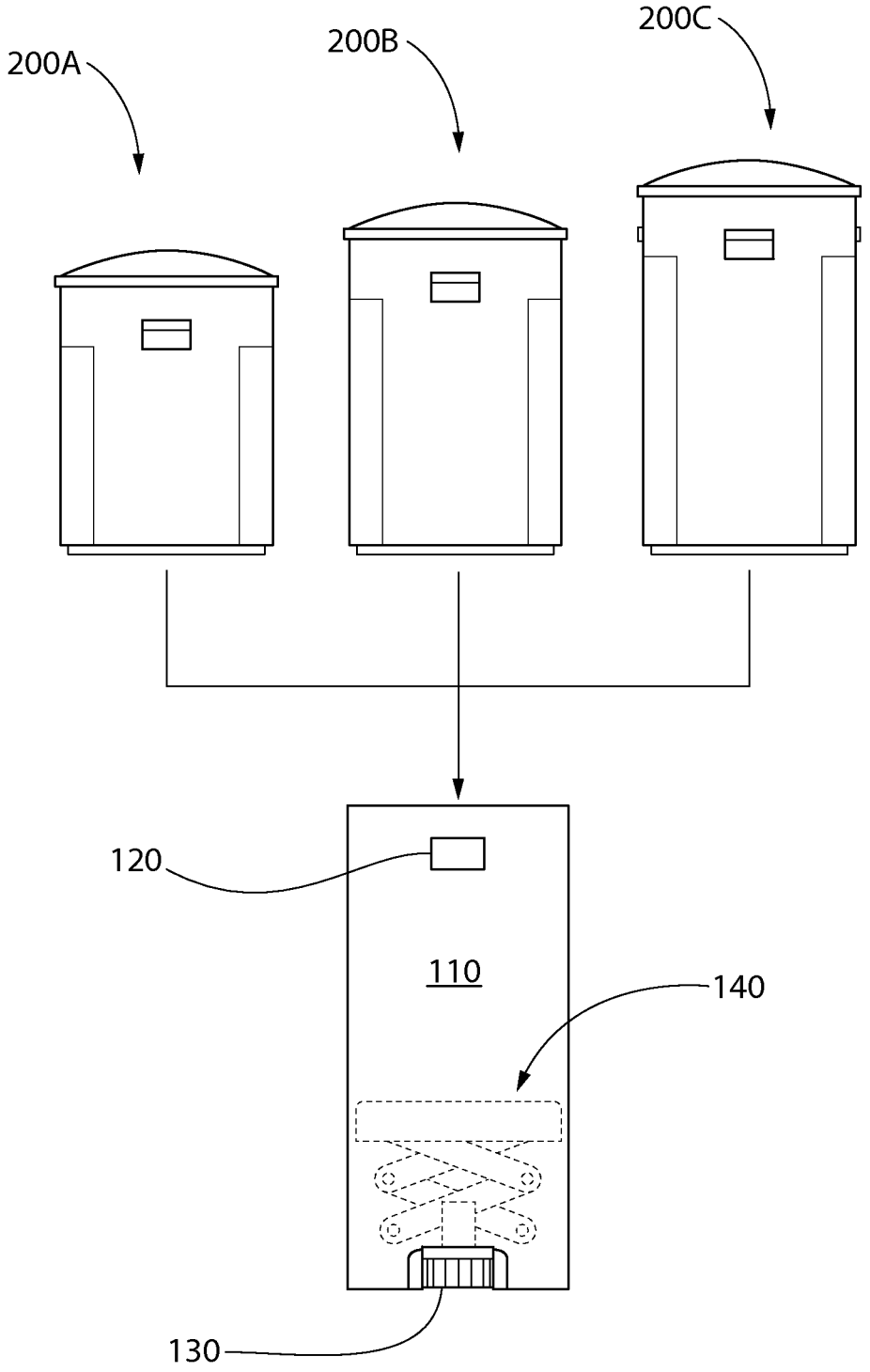
FIG. 5 depicts a side view of three illustrative cartridges of different sizes that may be loaded into the housing, according to an embodiment.

FIG. 5 depicts a side view of three illustrative cartridges 200A, 200B, 200C of different sizes that may be loaded into the housing 110, according to an embodiment. The cartridges 200A, 200B, 200C may each have substantially the same cross-sectional shape (e.g., width and depth); however, the cartridges 200A, 200B, 200C may have different heights. Any of the cartridges 200A, 200B, 200C may be inserted into the housing 110. Once the cartridge 200A, 200B, 200C is secured inside the housing, an elevation mechanism 140 may then be used to raise and lower the consumable produce 240 with respect to the housing 110 and the sleeve 210.

Figure 6:
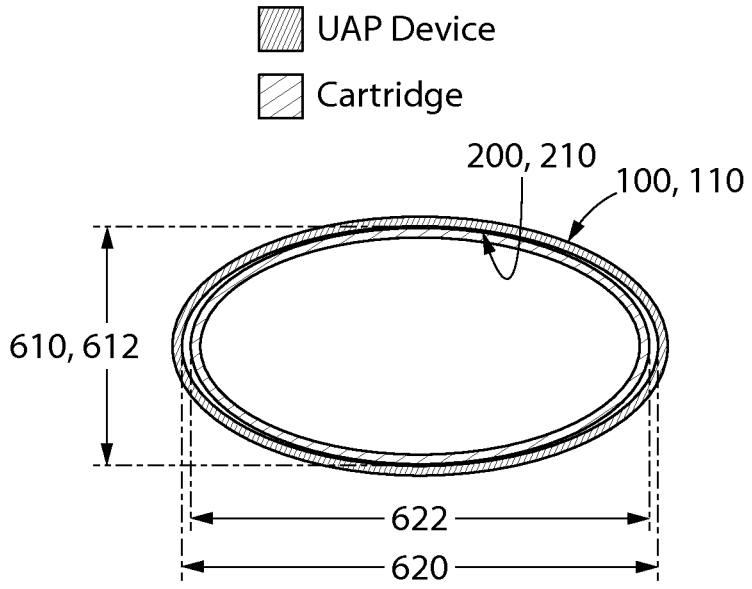
FIG. 6 depicts a cross-sectional view of the cartridge positioned within the housing taken through line 6-6 in FIG. 2, according to an embodiment.

FIG. 6 depicts a cross-sectional view of the cartridge 200 positioned within the housing 110 taken through line 6-6 in FIG. 2, according to an embodiment. As shown, the housing 110 and the cartridge 200 may each have a substantially elliptical cross-sectional shape. In at least one embodiment, the cartridge 200 may be at least partially held in place within the housing 110 by a friction fit. The inner minor diameter 610 of the housing 110 may be sized to be less than or equal to the outer minor diameter 612 of the cartridge 200 to form the friction fit. The inner major diameter 620 of the housing 110 may be larger than the outer major diameter 622 of the cartridge 200 to provide a clearance or gap. The user may squeeze the housing 110 along the major diameter to deform the housing 110 as the cartridge 200 is being loaded into (or unloaded from) the housing 110. This may temporarily neutralize the friction fit along the minor diameter to allow the cartridge 200 to move within the housing 110.

Figure 7:
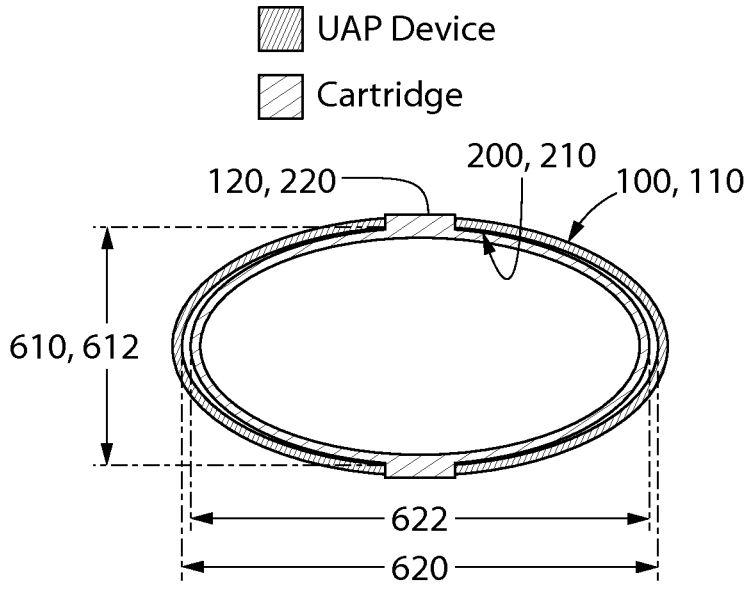
FIG. 7 depicts a cross-sectional view of the cartridge positioned within the housing taken through line 7-7 in FIG. 2, according to an embodiment.

FIG. 7 depicts a cross-sectional view of the cartridge positioned within the housing 110 taken through line 7-7 in FIG. 2, according to an embodiment. The first and second engaging mechanisms 120, 220 are shown engaged with one another. In the example shown, the first engaging mechanism 120 is an opening, the second engaging mechanism 220 is a protrusion, and the protrusion is extending at least partially through the opening. This may secure the cartridge 200 within the housing 110. As discussed above, when the user squeezes the housing 110 along the major diameter, the housing 110 may flex such that the minor inner diameter 612 of the housing 110 may increase, allowing the protrusion to be withdrawn from the opening, thereby allowing the cartridge 200 to move within the housing 110.

Figure 8:
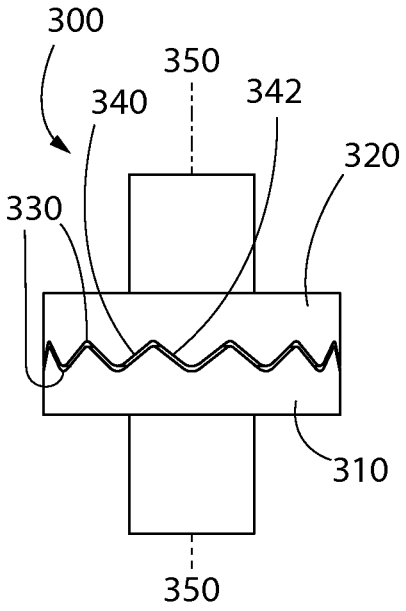
FIG. 8 depicts a side view of an illustrative clutch including first and second portions that are engaged with one another, according to an embodiment.
Figure 9:
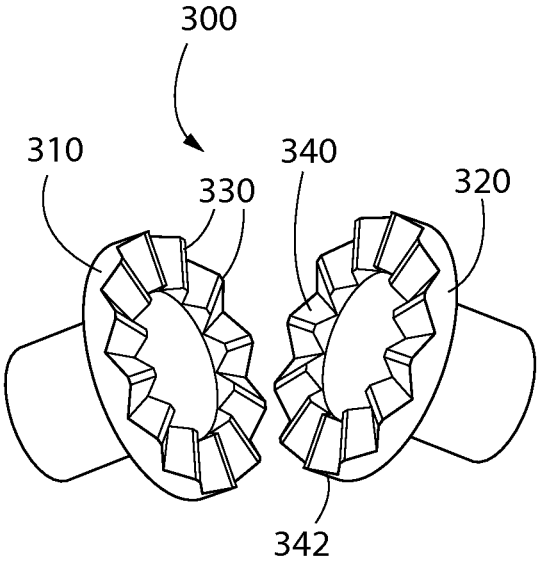
FIG. 9 depicts a perspective view of the first and second portions of the clutch separated from one another, according to an embodiment.

FIG. 8 depicts a side view of the clutch 300 showing the first portion 310 and the second portion 320 engaged with one another, and FIG. 9 depicts a top view of the first portion 310 and the second portion 320 separated from one another, according to an embodiment. The inner surfaces of the first and second portions 310, 320 of the clutch 300 may include corresponding bevels or teeth 330. Each tooth 330 may be defined by opposing side walls 340, 342. The side walls 340, 342 may each be oriented at an angle with respect to a central longitudinal axis 350 through the clutch 300. As shown, the angle is about 45 degrees; however, as will be appreciated, in other embodiments, the angle may be from about 10 degrees to about 80 degrees, about 20 degrees to about 70 degrees, or about 30 degrees to about 60 degrees. The teeth 330 may act to center the first and second portions 310, 320 of the clutch 300 about the central longitudinal axis 350 when the teeth 330 are engaged with one another. In various embodiments, the number of teeth 330 on each portion 310, 320 of the clutch 300 may range from 4 to 18 or from 6 to 12.

Figure 10:
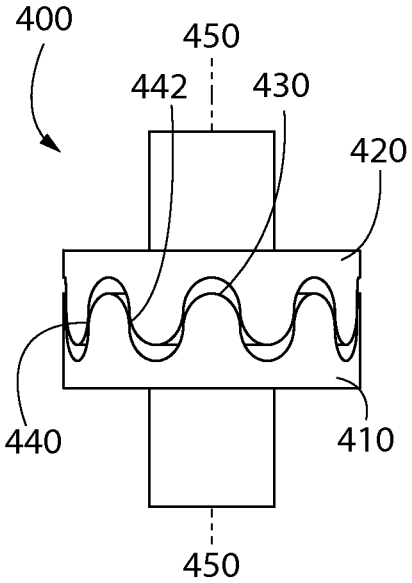
FIG. 10 depicts a side view of another illustrative clutch including first and second portions that are engaged with one another, according to an embodiment.
Figure 11:
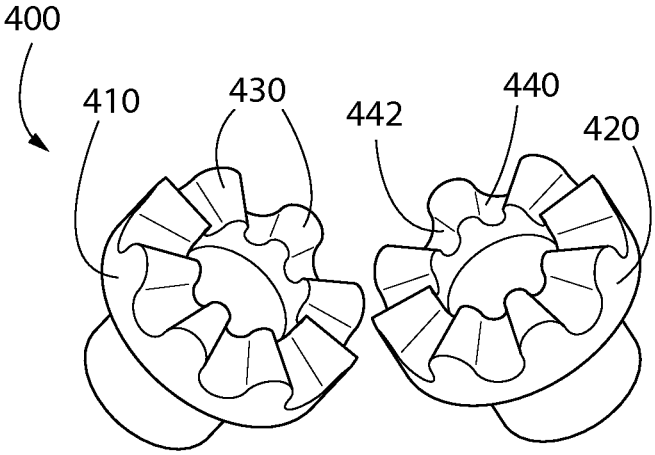
FIG. 11 depicts a perspective view of the first and second portions of the clutch from FIG. 10 separated from one another, according to an embodiment.

FIG. 10 depicts a side view of another illustrative clutch 400 showing a first portion 410 and a second portion 420 engaged with one another, and FIG. 11 depicts a top view showing the first portion 410 and the second portion 420 separated from one another, according to an embodiment. The inner surfaces of the first portion 410 and the second portion 420 of the clutch 400 may include corresponding bevels or teeth 430. Each tooth 430 may be defined by opposing side walls 440, 442. At least a portion of each side wall 440, 442 may be parallel to or aligned with, or nearly parallel to or aligned with, the central longitudinal axis 450 through the clutch 400. The vertical or nearly vertical portions of the side walls 440, 442 may allow the side walls 440, 442 to transmit more torque, or more torque without slipping, than the angled side walls 440, 442 shown in FIGS. 8 and 9. The vertical portions may also prevent the portions 410, 420 of the clutch 400 from pushing one another apart (e.g., slipping) during the transmission of torque or delay the onset of slipping. Additionally, the vertical portions may allow the portions 410, 420 of the clutch 400 to remain engaged with one another or delay the onset of slipping even if the portions 410, 420 are slightly spaced apart from one another.

When a user rotates the actuating device (e.g., wheel) 130, this may cause the portion of the clutch 300, 400 on the housing 110 to rotate. When the portions 310, 410, 320, 420 of the clutch 300 are engaged with one another, the portion 310, 410 of the clutch 300 on the housing 110 may transmit the rotation/torque to the portion 320, 420 of the clutch 300 on the cartridge 200. The portion 320, 420 of the clutch 300 on the cartridge 200 may then transmit the rotation/torque to an elevation mechanism 140. The elevation mechanism 140 may include a shaft that is coupled to the riser 230. When the rotation/torque is transferred to the shaft, the shaft may cause the riser 230 (and the consumable product 240) to advance toward or through the open end of the housing 110. When the actuating device 130 is rotated the opposite direction, the riser 230 (and the consumable product 240) may move away from the open end of the housing 110. In another embodiment, the elevation mechanism 140 (e.g., the shaft, riser 230, etc.) may be coupled to or positioned within the housing 110 rather than the cartridge 200. This may allow the clutch 300, 400 to be omitted.

Figure 12:
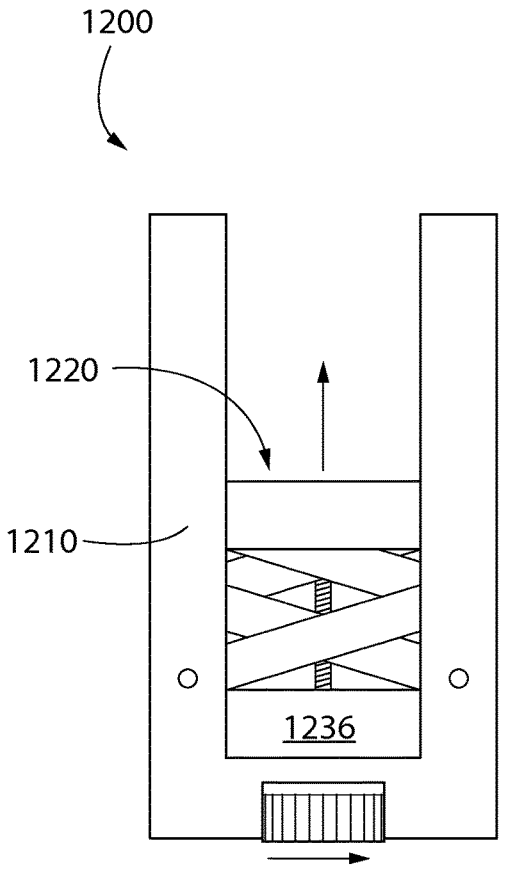
FIG. 12 depicts a front view of the consumer product showing an elevation mechanism in a first, lowered position, according to an embodiment.

FIG. 12 depicts a front view of another illustrative consumer product 1200 showing an elevation mechanism 1220 in a first, lowered position, according to an embodiment. The consumer product 1200 may include a housing 1210 defining an internal volume. The elevation mechanism 1220 may be positioned within the internal volume. When the elevation mechanism 1220 is in the first, lowered position, a ratio of a height of the elevation mechanism 1220 to a height of the housing 1210 may be from about 1:2 to about 1:5, about 1:2 to about 1:4, or about 1:2 to about 1:3.

Figure 13:
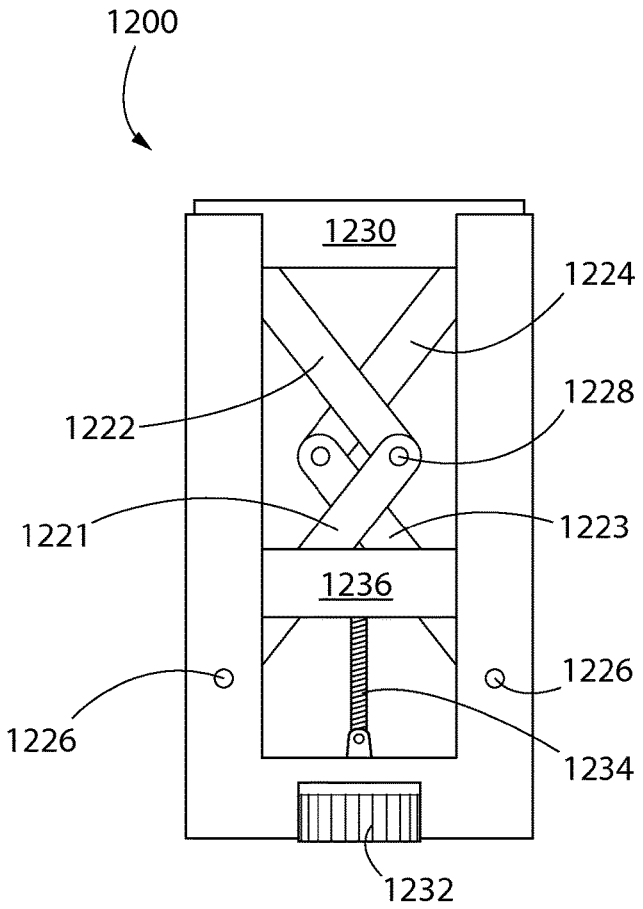
FIG. 13 depicts a front view of the consumer product of FIG. 12 showing the elevation mechanism in a second, raised position, according to an embodiment.

FIG. 13 depicts a front view of the consumer product 1200 of FIG. 12 showing the elevation mechanism 1220 in a second, raised position, according to an embodiment. The elevation mechanism 1220 may include a plurality of bar linkages 1221-1224. As shown, the elevation mechanism 1220 includes first and second sets of linkages 1221-1224 that are mirror images of one another, for example, in a scissor-type configuration. The first set may include a lower linkage 1221 and an upper linkage 1222. Similarly, the second set may include a lower linkage 1223 and an upper linkage 1224.

The lower linkages 1221, 1223 may have one end coupled to the housing 1210 (e.g., via pins 1226) and an opposing end coupled to the upper linkages 1222, 1224 (e.g., via hinge pins 1228). The hinge pins 1228 may allow the upper linkages 1222, 1224 to rotate or pivot with respect to the lower linkages 1221, 1223. Ends of the upper linkages 1222, 1224 opposing the hinge pins 1228 may be coupled to a riser 1230. In at least one embodiment, the hinge pins 1228 may be substituted by injection molded living hinges.

The housing 1210 may include an actuating device (e.g., a wheel) 1230 that may be rotated by a user. A threaded shaft 1234 may be coupled to the actuating device 1232 and positioned within the interior volume of the housing 1210. The shaft 1234 may be configured to rotate together with the actuating device 1232. A pusher 1236 may be coupled to the shaft 1234. The pusher 1236 may include an opening, and the shaft 1234 may extend at least partially therethrough. The surface of the pusher 1236 defining the opening may include one or more internal threads that are configured to engage the threads of the shaft 1234.

In operation, the user may rotate the actuating device 1232 in a first direction, which may cause the shaft 1234 to rotate in the first direction. When the shaft 1234 rotates in the first direction, the threaded engagement between the shaft 1234 and the pusher 1236 may cause the pusher 1236 to move upward within the housing 1210. As the pusher 1236 moves upward, the pusher 1236 may exert a force on one or more of the linkages 1221-1224, causing the linkages 1221-1224 to pivot or scissor, which may cause the linkages 1221-1224 to raise the riser 1230 within the housing 1210 (e.g., to the second position, as shown in FIG. 13). Thus, the linkages 1221-1224 may function as a scissor lift. A consumable product may be positioned on the riser 1230 and be advanced upward for use by the movement of the riser 1230. In at least one embodiment, the consumable product may be part of a cartridge, as discussed above. The cartridge may be discarded once the consumable product has been used up, and then another, new cartridge may be inserted into the housing 1210.

When the user rotates the actuating device 1232 in a second, opposing direction, the shaft 1234 may rotate in the second direction. When the shaft 1234 rotates in the second direction, the threaded engagement between the shaft 1234 and the pusher 1236 may cause the pusher 1236 to move downward within the housing 1210. As the pusher 1236 moves downward, the pusher 1236 may exert a force on one or more of the linkages 1221-1224, which may cause the linkages 1221-1224 to lower the riser 1230 within the housing 1210 (e.g., to the first position, as shown in FIG. 12).

Figure 14:
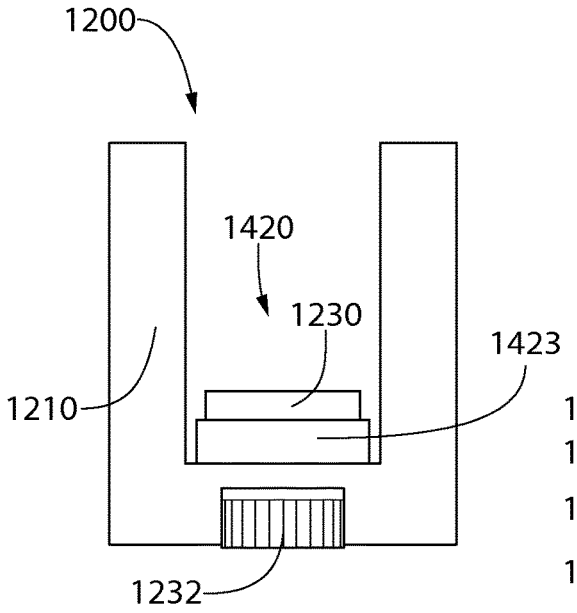
FIG. 14 depicts a front view of the consumer product of FIG. 12 showing another elevation mechanism in a first, lowered position, according to an embodiment.
Figure 15:
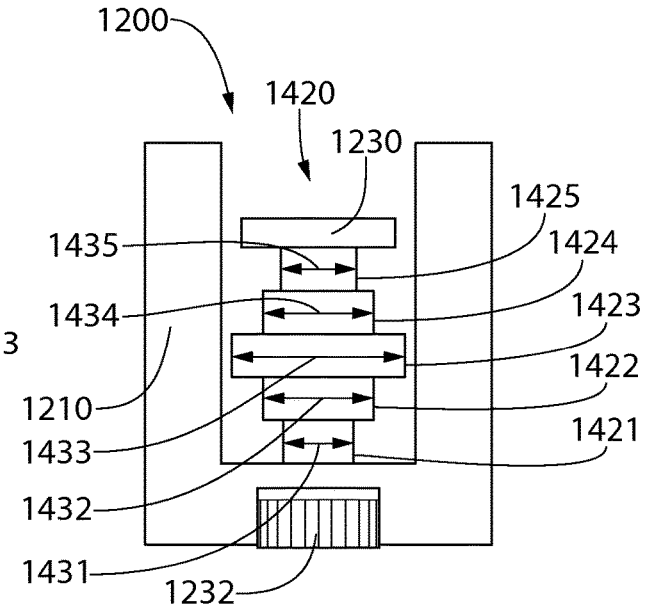
FIG. 15 depicts a front view of the consumer product showing the elevation mechanism from FIG. 14 in a second, raised position, according to an embodiment.

FIG. 14 depicts a front view of the consumer product 1200 of FIG. 12 showing another elevation mechanism 1420 in a first, lowered position, and FIG. 15 depicts a front view of the consumer product 1200 showing the elevation mechanism 1420 in a second, raised position, according to an embodiment. The elevation mechanism 1420 may include a plurality of tubular members (five are shown: 1421-1425). The tubular members 1421-1425 may have a cross-sectional shape that is a circle, an oval, a rectangle, or the like.

The tubular members 1421-1425 may be hollow and have varying cross-sectional lengths (e.g., diameters) 1431-1435 that allow the tubular members 1421-1425 to stack inside one another (as shown in FIG. 14) and to expand or telescope out into an expanded position (as shown in FIG. 15). For example, the cross-sectional length (e.g., diameter) 1432 of the tubular member 1422 may be less than the cross-sectional length (e.g., diameter) 1433 of the tubular member 1423 above it but greater than the cross-sectional length (e.g., diameter) 1431 of the tubular member 1421 below it. As shown in FIG. 15, the tubular member 1423 with the greatest cross-sectional length (e.g., diameter) 1433 may be positioned between at least one lower tubular member 1421, 1422 and at least one upper tubular member 1424, 1425.

Each tubular member (e.g., tubular member 1422) may be coupled to one or more other tubular members (e.g., tubular members 1421, 1423). In at least one embodiment, the tubular members 1421-1425 may be coupled together via a threaded engagement. For example, the inner surface of the tubular member 1422 may have threads on the inner surface thereof that engage corresponding threads on the outer surface of the tubular member 1421, and the outer surface of the tubular member 1422 may have threads on the outer surface thereof that engage corresponding threads on the inner surface of the tubular member 1423.

In operation, the user may rotate the actuating device 1232 in a first direction, which may cause one or more of the tubular members 1421-1425 to rotate. In at least one embodiment, some of the tubular members 1421-1425 may rotate while others of the tubular members 1421-1425 may not rotate. For example, the cross-sectional shape(s) of the housing 1210 and/or the riser 1230 may not be round. Thus, as the riser 1230 moves up and down within the housing 1210, the riser 1230 may not rotate within the housing 11210. As the riser 1230 may be coupled to at least one of the tubular members (e.g., tubular member 1425), the tubular member 1425 may also be prevented from rotating. In another embodiment, one or more of the tubular members 1421-1425 may be coupled to one or more vertical splines on the inner surface of the housing 1210 to prevent rotation.

When the one or more tubular members 1421-1425 rotate in the first direction, the threaded engagement between the tubular members 1421-1425 may cause the tubular members 1421-1425 to expand upward within the housing 1210 (e.g., like a telescope), as shown in FIG. 15. A ratio of the height of the elevation mechanism 1420 in the expanded position (FIG. 15) to the height of the elevation mechanism 1420 in the collapsed position (FIG. 14) may be from about 2:1 to about 4:1, or from about 3:1 to about 5:1.

The uppermost tubular member (e.g., tubular member 1425) may be coupled to the riser 1230. In at least one embodiment, the riser 230 of the cartridge 200 (see FIG. 1) may move together with the riser 1230 of the elevation mechanism 1420. The consumable product may be positioned on the riser 230 of the cartridge 200 and be advanced upward for use by the movement of the risers 230, 1230. The cartridge 200 may be discarded once the consumable product has been used up, and then another, new cartridge 200 may be inserted into the housing 1110.

When the user rotates the actuating device 1232 in a second, opposing direction, the one or more tubular members 1421-1425 may rotate in the second direction. When the one or more tubular members 1421-1425 rotate in the second direction, the threaded engagement between the tubular members 1421-1425 may cause the tubular members 1421-1425 to move downward and stack within one another within the housing 1210, as shown in FIG. 14.

Figure 16:
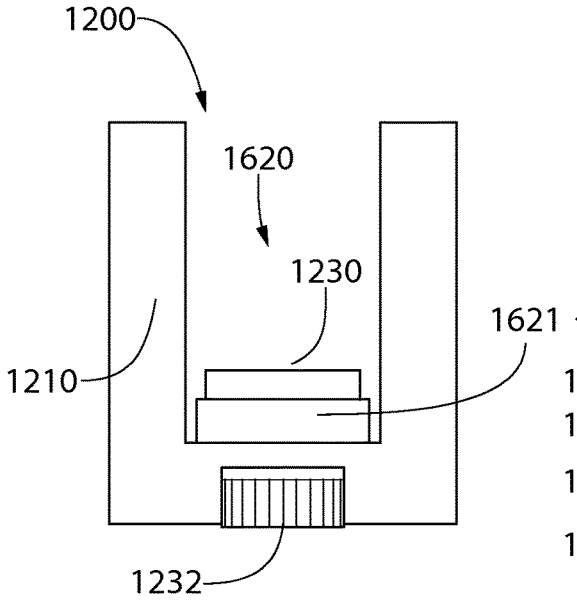
FIG. 16 depicts a front view of the consumer product of FIG. 12 showing another elevation mechanism in a first, lowered position, according to an embodiment.
Figure 17:
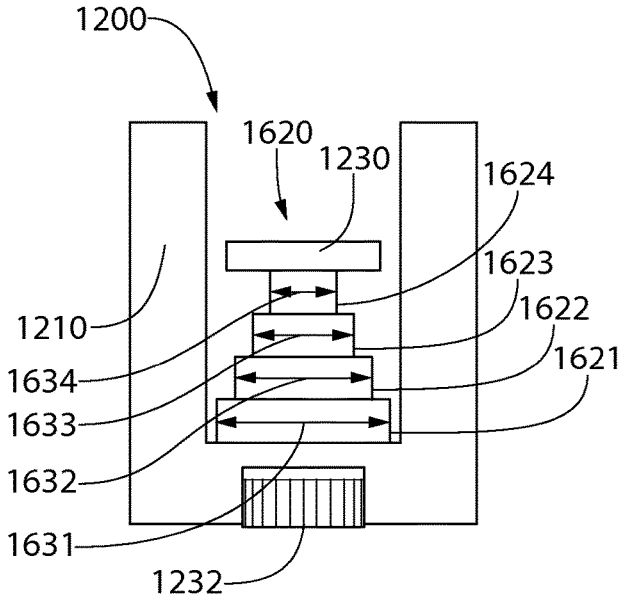
FIG. 17 depicts a front view of the consumer product showing the elevation mechanism from FIG. 16 in a second, raised position, according to an embodiment.

FIG. 16 depicts a front view of the consumer product 1200 of FIG. 12 showing another elevation mechanism 1620 in a first, lowered position, and FIG. 17 depicts a front view of the consumer product 1200 showing the elevation mechanism 1620 in a second, raised position, according to an embodiment. The elevation mechanism 1620 may include a plurality of tubular members (four are shown: 1621-1624). The tubular members 1621-1624 may have a cross-sectional shape that is a circle, an oval, a rectangle, or the like.

The tubular members 1621-1624 may be hollow and have varying cross-sectional lengths (e.g., diameters) 1631-1634 that allow the tubular members 1621-1624 to stack inside one another (as shown in FIG. 16) and to expand or telescope out into an expanded position (as shown in FIG. 17). For example, the cross-sectional length (e.g., diameter) 1632 of the tubular member 1622 may be less than the cross-sectional length (e.g., diameter) 1631 of the tubular member 1621 below it but greater than the cross-sectional length (e.g., diameter) 1633 of the tubular member 1623 above it. As shown in FIG. 17, the tubular member 1621 with the greatest cross-sectional length (e.g., diameter) 1631 may be positioned below the other tubular members 1622, 1623, 1624. Although not shown, in another embodiment, the tubular member 1621 with the greatest cross-sectional length (e.g., diameter) 1631 may be positioned above the other tubular members 1622, 1623, 1624 (e.g., coupled to the riser 1230).

Each tubular member (e.g., tubular member 1622) may be coupled to one or more other tubular members (e.g., tubular members 1621, 1623). In at least one embodiment, the tubular members 1621-1624 may be coupled together via a threaded engagement. For example, the inner surface of the tubular member 1622 may have threads on the inner surface thereof that engage corresponding threads on the outer surface of the tubular member 1623, and the outer surface of the tubular member 1622 may have threads on the outer surface there of that engage corresponding threads on the inner surface of the tubular member 1621.

In operation, the user may rotate the actuating device 1232 in a first direction, which may cause one or more of the tubular members 1621-1624 to rotate. In at least one embodiment, some of the tubular members 1621-1624 may rotate while others of the tubular members 1621-1624 may not rotate. For example, the cross-sectional shape(s) of the housing 1210 and/or the riser 1230 may not be round. Thus, as the riser 1230 moves up and down within the housing 1210, the riser 1230 may not rotate within the housing 1210. As the riser 1230 may be coupled to at least one of the tubular members (e.g., tubular member 1624), the tubular member 1624 may also be prevented from rotating. In another embodiment, one or more of the tubular members 1621-1624 may be coupled to one or more vertical splines on the inner surface of the housing 1210 to prevent rotation.

When the one or more tubular members 1621-1624 rotate in the first direction, the threaded engagement between the tubular members 1621-1624 may cause the tubular members 1621-1624 to expand upward within the housing 1210 (e.g., like a wedding cake), as shown in FIG. 17. A ratio of the height of the elevation mechanism 1620 in the expanded position (FIG. 17) to the height of the elevation mechanism 1620 in the collapsed position (FIG. 16) may be from about 2:1 to about 4:1, or from about 3:1 to about 5:1.

The uppermost tubular member (e.g., tubular member 1624) may be coupled to the riser 1230. In at least one embodiment, the riser 230 of the cartridge 200 (see FIG. 1) may move together with the riser 1230 of the elevation mechanism 1620. The consumable product may be positioned on the riser 230 of the cartridge 200 and be advanced upward for use by the movement of the risers 230, 1230. The cartridge 200 may be discarded once the consumable product has been used up, and then another, new cartridge 200 may be inserted into the housing 1210.

When the user rotates the actuating device 1232 in a second, opposing direction, the one or more tubular members 1621-1624 may rotate in the second direction. When the one or more tubular members 1621-1624 rotate in the second direction, the threaded engagement between the tubular members 1621-1624 may cause the tubular members 1621-1624 to move downward and stack within one another within the housing 1210, as shown in FIG. 16.

Figure 18:
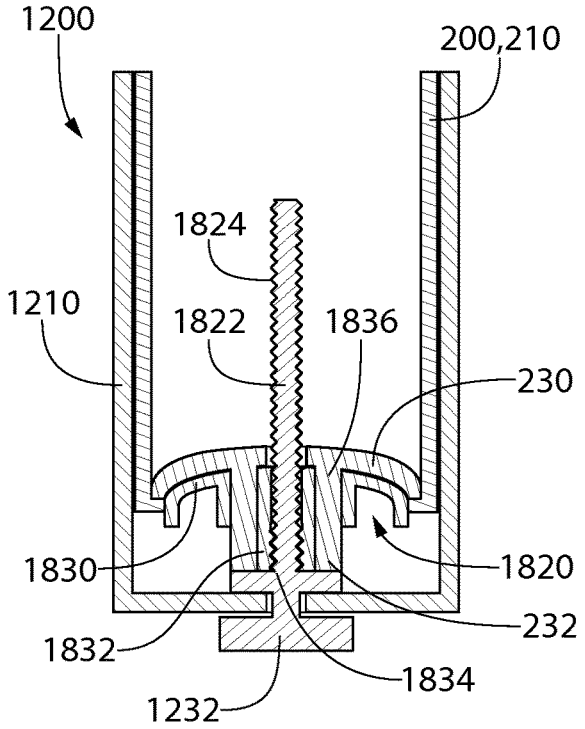
FIG. 18 depicts a front view of the consumer product of FIG. 12 showing another elevation mechanism in a first, lowered position, according to an embodiment.

FIG. 18 depicts a front view of the consumer product 1200 of FIG. 12 showing another elevation mechanism 1820 in a first, lowered position, according to an embodiment. The elevation mechanism 1820 may include a shaft 1822 that is coupled to the actuating device 1232. The shaft 1822 may include threads 1824 on an outer surface thereof.

The elevation mechanism 1820 may also include a riser 1830 that is positioned around the shaft 1822. The riser 1830 may include one or more protrusions 1832 that extend axially-therefrom. The protrusions 1832 may be circumferentially-offset from one another about a central longitudinal axis. The protrusions 1832 may include threads 1834 on an inner surface thereof that are configured to engage the threads 1824 on the outer surface of the shaft 1822. The riser 1830 may also include one or more openings 1836 (best seen in FIG. 19) formed axially-therethrough.

The cartridge 200 may include a sleeve 210 having a riser 230 positioned therein. The riser 230 may include one or more protrusions 232 extending axially-therefrom. When the cartridge 200 is positioned within the housing 1210 of the consumer product 1200 (as shown in FIG. 18), the protrusions 232 of the riser 230 of the cartridge 200 may extend at least partially through the openings 1836 in the riser 1830 of the housing 1210. As such, the protrusions 232 of the riser 230 of the cartridge 200 may at least partially surround the protrusions 1832 of the riser 1830 of the housing 1210. This may exert a radially-inward force on the protrusions 1832 of the riser 1830 that causes the threads 1834 on the inner surface of the protrusions 1832 to engage the threads 1824 on the outer surface of the shaft 1822.

Figure 19:
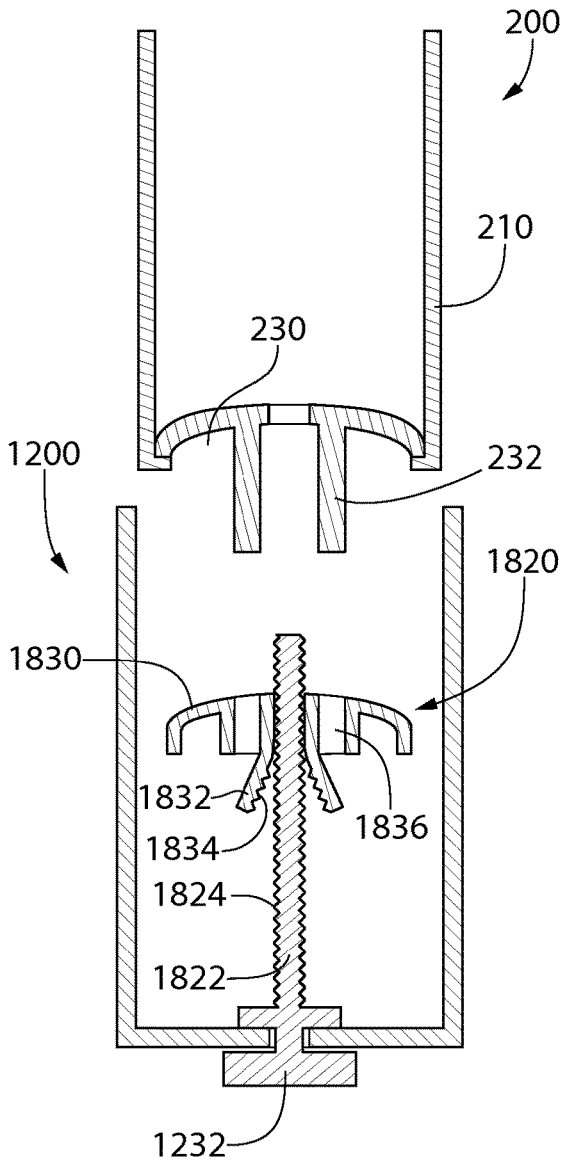
FIG. 19 depicts a front view of the consumer product showing the elevation mechanism from FIG. 18 in a second, raised position, according to an embodiment.

FIG. 19 depicts a front view of the consumer product 1200 showing the elevation mechanism 1820 in a second, raised position, according to an embodiment. In operation, the user may rotate the actuating device 1232 in a first direction, which may cause the shaft 1822 to rotate. As the shaft 1822 rotates, the engagement between the threads 1824 of the shaft 1822 and the threads 1834 of the riser 1830 may cause the riser 1830 to move upward within the housing 1210, as shown in FIG. 19. This, in turn, may cause the riser 230 of the cartridge 200 to move upward within the sleeve 210. The consumable product may be positioned on the riser 230 of the cartridge 200 and be advanced upward for use by the movement of the riser 230. The cartridge 200 and the riser 230 may be discarded once the consumable product has been used up.

Once the cartridge 200 is discarded, as shown in FIG. 19, the protrusions 232 of the riser 230 of the cartridge 200 may no longer at least partially surround the protrusions 1832 of the riser 1830 of the housing 1210. The protrusions 1832 of the riser 1830 of the housing 1210 may be biased radially-outward. Thus, when the protrusions 232 of the riser 230 of the cartridge 200 are no longer present to force the protrusions 1832 of the riser 1830 of the housing 1210 into engagement with the shaft 1822, the threads 1834 on the inner surface of the protrusions 1832 may disengage with the threads 1824 of the shaft 1822, as shown in FIG. 19. This may allow the riser 1830 of the housing 1210 to quickly descend back to the position shown in FIG. 18 either due to gravity, by a user directly applying a downward force on the riser 1830, or by a user applying a downward force using a cartridge 200 and a riser 230. As a result, the riser 1830 may be relocated to its initial, lower position without having to rotate the actuating device 1232, allowing for a quicker, easier descent of the riser 1830. The new cartridge 200 may be inserted before, after, or at the same time as the riser 1830 descends to its initial, lower position.

Figure 20:
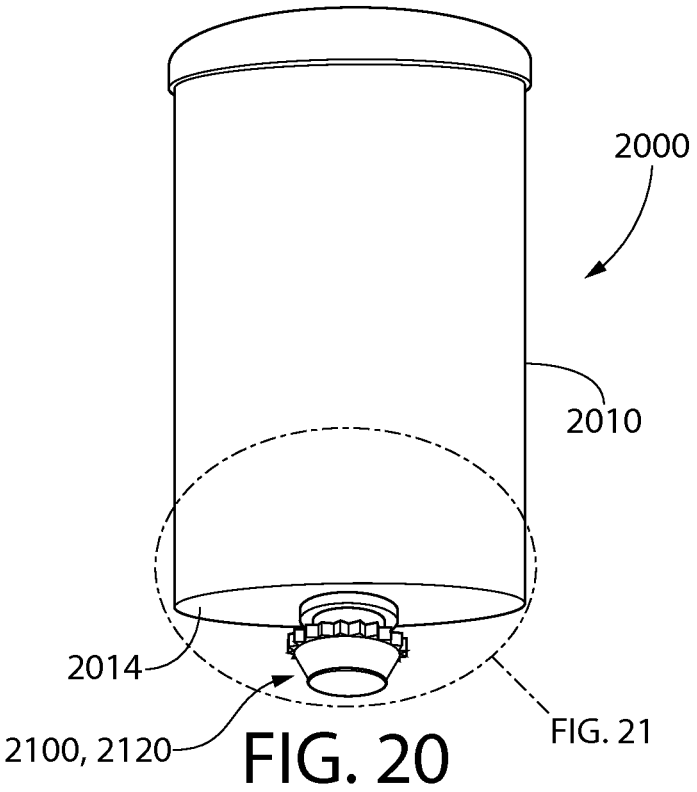
FIG. 20 depicts a perspective view of another illustrative cartridge.
Figure 21:
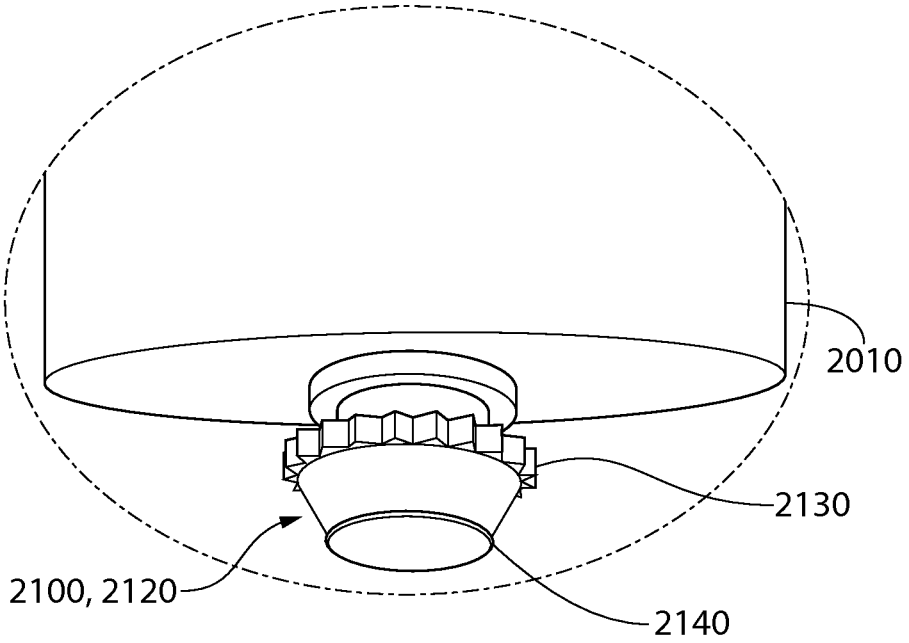
FIG. 21 depicts an enlarged portion of the cartridge, according to an embodiment.

FIG. 20 depicts a perspective view of another illustrative cartridge 2000, and FIG. 21 depicts an enlarged portion of the cartridge 2000, according to an embodiment. A lower end 2014 of the cartridge 2000 may be closed. A portion 2120 of a clutch 2100 may extend axially from the lower end 2014 of the cartridge 2000. The portion 2120 of the clutch 2100 may be at least partially frustoconical, with the cross-sectional length (e.g., diameter) decreasing moving away from the lower end 2014 of the cartridge 2000.

The portion 2120 of the clutch 2100 may include a plurality of teeth 2130. The teeth 2130 may extend radially-outward from the portion 2120 of the clutch 2100 and be circumferentially-offset from one another. The teeth 2130 may be substantially triangular and form a tongue and groove arrangement. The portion 2120 of the clutch 2100 may also include a button 2140. As shown, the button 2140 may be positioned farther away from the sleeve 2010 than the teeth 2130. The button 2140 may extend radially-outward from the portion 2120 of the clutch 2100.

Figure 22:
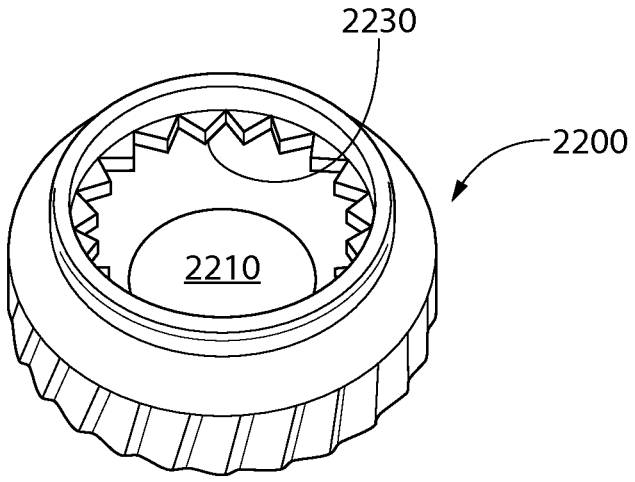
FIG. 22 depicts a perspective view of another illustrative actuating device, according to an embodiment.

FIG. 22 depicts a perspective view of another illustrative actuating device 2200, according to an embodiment. The actuating device 2200 may be a wheel (e.g., a "thumb screw") that is coupled to the lower end of the housing of the consumer product. The actuating device 2200 may have a bore 2210 formed at least partially therethrough. A cross-sectional length (e.g., diameter) of the bore 2210 may be less than or equal to the cross-sectional length (e.g., diameter) of the button 2140.

An inner surface of the actuating device 2200 that defines the bore 2210 may have a plurality of teeth 2230 formed thereon. The teeth 2230 may extend radially-inward from the inner surface of the actuating device 2200 and be circumferentially-offset from one another. The teeth 2230 may be substantially triangular and form a tongue and groove arrangement. As such, the teeth 2130 of the first portion 2120 of the clutch 2100 may be configured to engage the teeth 2230 of the actuating device 2200 when the first portion 2120 of the clutch 2100 is inserted into the actuating device 2200, as described in greater detail below. Thus, the actuating device 2200 may also be referred to as a second portion of the clutch 2100.

Figure 23:
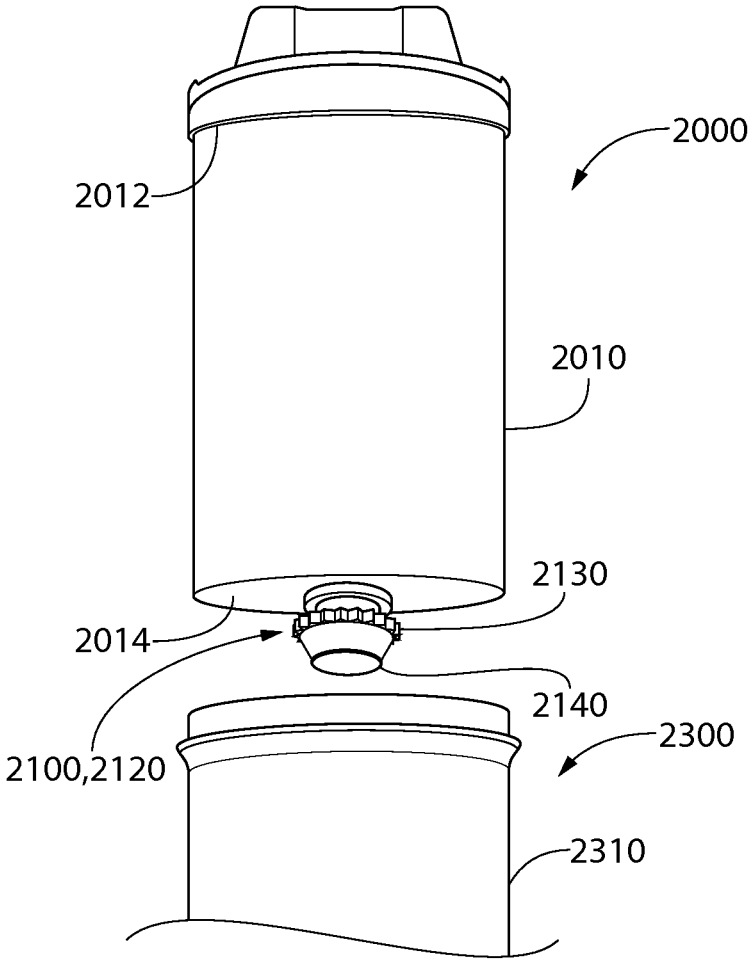
FIG. 23 depicts a perspective view of the cartridge of FIG. 20 being inserted into a consumer product, according to an embodiment.

FIG. 23 depicts a perspective view of the cartridge 2000 of FIG. 20 being inserted into a consumer product 2300, according to an embodiment. In operation, the lower end 2014 of the cartridge (e.g., the end having the first portion 2120 of the clutch 2100) may be inserted into the housing 2310 of the consumer product 2300. Although not shown, the lower end of the housing 2310 may have an opening through which the first portion 2120 of the clutch 2100 may be inserted. The cartridge 2000 may include a shoulder 2012 that extends radially-outward therefrom. The cartridge 200 may be fully inserted into the housing 2310 of the consumer product 2300 when the shoulder 2012 contacts an upper end of the housing 2310. The sleeve 2010 may be held in position within the housing by a snap fit.

Figure 24:
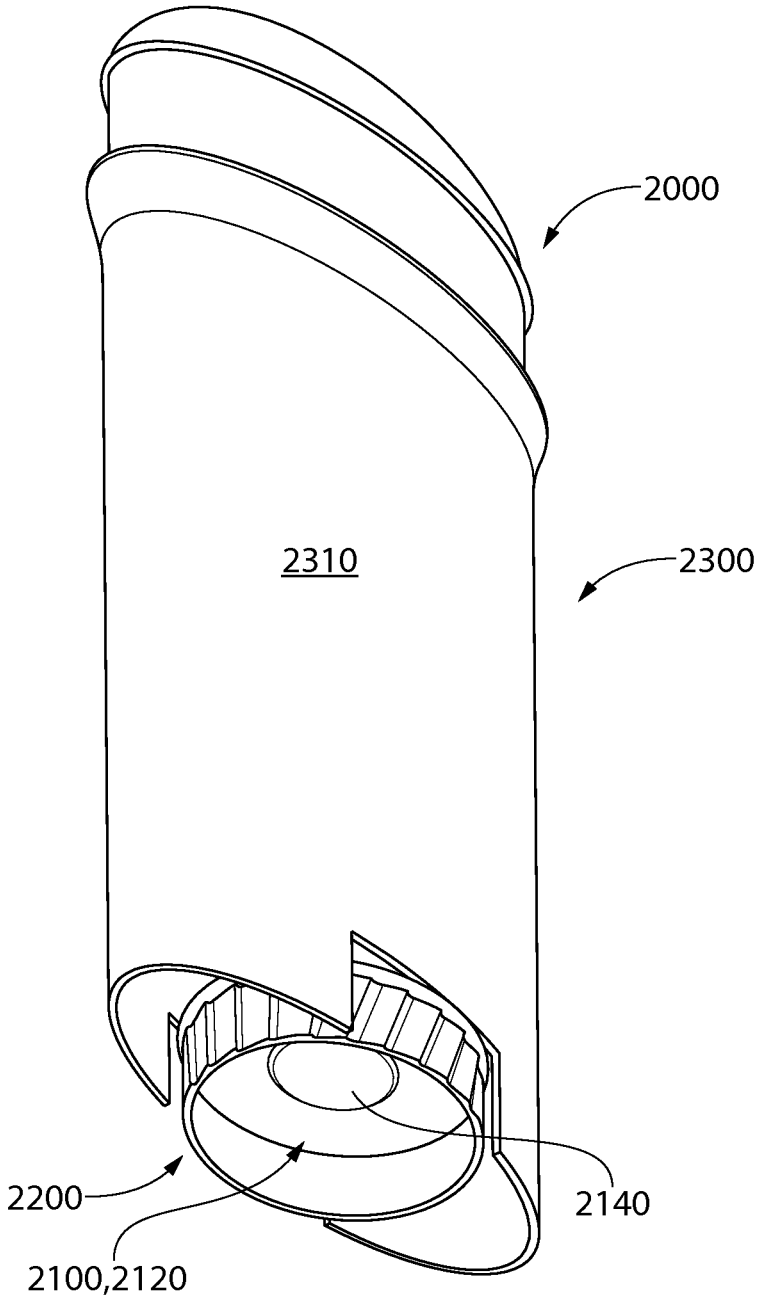
FIG. 24 depicts the actuating device of FIG. 22 being coupled to the cartridge as the cartridge is inserted into the consumer product, according to an embodiment.

FIG. 24 depicts the actuating device 2200 of FIG. 22 being coupled to the cartridge 2000 as the cartridge 2000 is inserted into the consumer product 2300, according to an embodiment. Once the cartridge 2000 is fully inserted into the housing 2310, the first portion 2120 of the clutch 2100 (see FIG. 21) may extend through the opening in the lower end of the housing 2310 of the consumer product 2300. The user may then press the actuating device 2200 against the first portion 2120 of the clutch 2100 such that the first portion 2120 of the clutch 2100 is inserted into the bore 2210 of the actuating device 2200.

As the cross-sectional length (e.g., diameter) of the button 2140 may be greater than or equal to the cross-sectional length (e.g., diameter) of the bore 2210, the button 2140 may resist passing through the bore 2210. However, when the force exerted by the user on the actuating device 2200 exceeds a predetermined amount, the button 2140 and/or the actuating device 2200 may temporarily deform slightly so that the button 2140 may squeeze through the bore 2210 (e.g., a "snap" fit). The button 2140 may then rest against a lower end of the actuating device 2200, preventing the actuating device 2200 from disengaging the button 2140 unless a force exceeding the predetermined amount is exerted in an opposing direction.

Once the button 2140 secures the first portion 2120 of the clutch 2100 with the actuating device 2200, the teeth 2130 of the first portion 2120 of the clutch 2100 may be engaged with the teeth 2230 of the actuating device 2200. The user may then rotate the actuating device 2200. The engagement of the teeth 2130, 2230 may transfer the rotational movement of the actuating device 2200 to a shaft, which may rotate within the cartridge 2000. The rotation of the shaft may cause a riser to move upwards within the cartridge 2000, thereby lifting the consumable product for use.

When the consumable product is used up or exhausted, the user may apply the predetermined force on the actuating device 2200 in a second, opposing direction to pull the actuating device 2000 off of the button 2140 of the first portion 2120 of the clutch 2100. The cartridge 2000 may then be removed from the housing 2310 and discarded, and a new cartridge 2000 may be inserted into the housing 2310 as described above.

What is claimed is:

1. A consumer product, comprising:

a housing defining an internal volume;

a first engaging mechanism coupled to or integral with the housing, wherein a cartridge is configured to be inserted into the internal volume through a first end of the housing, and wherein the first engaging mechanism is configured to engage a second engaging mechanism on the cartridge;

an elevation mechanism positioned at least partially within the internal volume;

an actuating device coupled to the housing proximate to a second end of the housing, wherein the elevation mechanism is configured to move in response to actuation of the actuating device;

a clutch having a first portion and a second portion, the first portion positioned at least partially within the internal volume and configured to rotate in response to actuation of the actuating device; and the cartridge positioned within the internal volume, wherein a consumable product is positioned within the cartridge, wherein the cartridge comprises:

a sleeve;

a riser positioned at least partially within the sleeve;

wherein the first and second portions of the clutch are configured to engage one another when the cartridge is in the internal volume of the housing;

wherein the housing and the cartridge both have substantially elliptical cross-sections, wherein a major inner diameter of the housing is greater than a major outer diameter of the cartridge, and wherein a minor inner diameter of the housing is less than or equal to a minor outer diameter of the cartridge.

2. The consumer product of claim 1, wherein the first engaging mechanism comprises an opening formed through the housing.

3. The consumer product of claim 1, wherein the first engaging mechanism comprises a recess formed in an inner surface of the housing.

4. The consumer product of claim 1, wherein the first engaging mechanism comprises a protrusion formed on an inner surface of the housing and extending inwardly therefrom.

5. The consumer product of claim 1, wherein each of the first portion and the second portion of the clutch comprises a plurality of teeth.

6. The consumer product of claim 1, wherein the second portion of the clutch is configured to rotate in response to rotation of the first portion of the clutch, and wherein the riser and the consumable product are configured to move within the sleeve in response to rotation of the second portion of the clutch.

* * * * *